US010304380B2

(12) United States Patent
Zhu

(10) Patent No.: US 10,304,380 B2
(45) Date of Patent: May 28, 2019

(54) ORGANIC LIGHT-EMITTING PIXEL DRIVING CIRCUIT, DRIVING METHOD, AND ORGANIC LIGHT-EMITTING DISPLAY PANEL

(71) Applicants: Shanghai Tianma AM-OLED Co., Ltd., Shanghai (CN); Tianma Micro-Electronics Co., Ltd., Shenzhen (CN)

(72) Inventor: Renyuan Zhu, Shanghai (CN)

(73) Assignees: Shanghai Tianma AM-OLED Co., Ltd., Shanghai (CN); Tianma Micro-Electronics Co., Ltd., Shenzhen (CN)

( * ) Notice: Subject to any disclaimer, the term of this patent is extended or adjusted under 35 U.S.C. 154(b) by 170 days.

(21) Appl. No.: 15/489,161

(22) Filed: Apr. 17, 2017

(65) Prior Publication Data

US 2017/0221420 A1 Aug. 3, 2017

(30) Foreign Application Priority Data

Dec. 13, 2016 (CN) ..... 2016 1 1145820

(51) Int. Cl.
*G09G 3/3233* (2016.01)

(52) U.S. Cl.
CPC ... *G09G 3/3233* (2013.01); *G09G 2300/0819* (2013.01); *G09G 2300/0842* (2013.01);
(Continued)

(58) Field of Classification Search
None
See application file for complete search history.

(56) References Cited

U.S. PATENT DOCUMENTS 8,531,361 B2 9/2013 Nam
2009/0289876 A1* 11/2009 Chun ..... G09G 3/3233 345/80

(Continued)

FOREIGN PATENT DOCUMENTS

CN 102956192 A 3/2013
CN 103778883 A 5/2014

(Continued)

*Primary Examiner* — Sepehr Azari
(74) *Attorney, Agent, or Firm* — Anova Law Group, PLLC

(57) ABSTRACT

An organic light-emitting pixel driving circuit, a driving method, and an organic light-emitting display panel are provided. The pixel driving circuit includes a driving transistor, a light-emitting element, an initialization unit, a threshold detecting unit, a compensating unit, a first light-emitting control unit and a second light-emitting control unit. The initialization unit transmits a data voltage signal to a gate electrode of the driving transistor, and transmits a reference voltage signal to a source electrode of the driving transistor and an anode of the light-emitting element. The threshold detecting unit detects a threshold voltage of the driving transistor and holds at least one voltage signal inputted to the driving transistor. The compensating unit transmits a first power supply voltage signal to the gate electrode of the driving transistor. The first and second light-emitting control units are connected to first and second light-emitting control signal lines, respectively.

20 Claims, 8 Drawing Sheets

(52) U.S. Cl.
CPC ..... *G09G 2300/0861* (2013.01); *G09G 2310/0256* (2013.01); *G09G 2320/0233* (2013.01); *G09G 2320/0238* (2013.01); *G09G 2320/0295* (2013.01); *G09G 2320/043* (2013.01); *G09G 2320/045* (2013.01)

(56) References Cited

U.S. PATENT DOCUMENTS

| | | | | |
|---|---|---|---|---|
| 2014/0184665 | A1* | 7/2014 | Yoon | G09G 3/3241 345/691 |
| 2015/0170569 | A1* | 6/2015 | Han | G09G 3/3258 345/78 |
| 2015/0243203 | A1 | 8/2015 | Kim et al. | |
| 2016/0189635 | A1 | 6/2016 | Lee et al. | |
| 2016/0284276 | A1* | 9/2016 | Gupta | G09G 3/3233 |
| 2018/0005576 | A1* | 1/2018 | Yoon | G09G 3/3233 |
| 2018/0006263 | A1* | 1/2018 | Yoon | H01L 51/0508 |

FOREIGN PATENT DOCUMENTS

| | | | |
|---|---|---|---|
| CN | 104680978 | A | 6/2015 |
| CN | 105575320 | A | 5/2016 |
| CN | 105632404 | A | 6/2016 |
| CN | 105825815 | A | 8/2016 |
| CN | 106023895 | A | 10/2016 |

* cited by examiner

ORGANIC LIGHT-EMITTING PIXEL DRIVING CIRCUIT, DRIVING METHOD, AND ORGANIC LIGHT-EMITTING DISPLAY PANEL

CROSS-REFERENCES TO RELATED APPLICATIONS

This application claims priority of Chinese Patent Application No. 201611145820.5, filed on Dec. 13, 2016, the entire contents of which are hereby incorporated by reference.

FIELD OF THE DISCLOSURE

The present disclosure generally relates to the field of display technology and, more particularly, relates to an organic light-emitting pixel driving circuit, a driving method, and an organic light-emitting display panel.

BACKGROUND

Organic light-emitting diode (OLED) display devices, featured with wide viewing angle, light weight, low power consumption, high brightness, and other excellent performance, are widely used in various electronic devices. An OLED display device includes an OLED matrix (i.e. pixel matrix) having a plurality of OLEDs, and a plurality of pixel driving circuits. The pixel driving circuit provides a light-emitting current to an OLED in the OLED matrix, driving the OLED to emit light.

The luminance of the OLED is proportional to the magnitude of the light-emitting current flowing the OLED. The pixel driving circuit in the existing technology often includes a driving transistor, and the light-emitting current generated in the respective pixel driving circuit is closely related to the threshold voltage of the driving transistor. The threshold voltages of the driving transistors may not be completely the same due to various factors, such as the manufacturing variation of the driving transistor, the aging of the driving transistor itself, etc. Because the threshold voltages of the driving transistors are not exactly the same, the light-emitting currents flowing through the respective OLEDs are not exactly the same in the organic light-emitting display device. Thus, the luminance of the OLEDs is not exactly the same, and the organic light-emitting display panel exhibits poor uniformity in brightness when displaying images.

The disclosed organic light-emitting pixel driving circuit, driving method, and organic light-emitting display panel are directed to solve one or more problems set forth above and other problems.

BRIEF SUMMARY OF THE DISCLOSURE

One aspect of the present disclosure provides an organic light-emitting pixel driving circuit. The organic light-emitting pixel driving circuit comprises a driving transistor; a light-emitting element having a cathode connected to a second power supply voltage terminal; an initialization unit connected to a data line and a reference voltage terminal, and under a control of a signal at a first scan signal line, configured to transmit a data voltage signal on the data line to a gate electrode of the driving transistor, and transmit a reference voltage signal from the reference voltage terminal to a source electrode of the driving transistor and an anode of the light-emitting element; a threshold detecting unit connected to the driving transistor and configured to detect a threshold voltage of the driving transistor and hold at least one voltage signal inputted to the driving transistor, a compensating unit connected to the driving transistor, under a control of a signal at a second scan signal line, configured to transmit a first power supply voltage signal outputted from a first power supply voltage terminal to the gate electrode of the driving transistor; a first light-emitting control unit connected to a first light-emitting control signal line; and a second light-emitting control unit connected to a second light-emitting control signal line.

Another aspect of the present disclosure provides a driving method for the organic light-emitting driving circuit. The driving method comprises: during an initialization period, providing a first level signal to the first scan signal line, the first light-emitting control signal line, and the second light-emitting control signal line, providing a second level signal to the second scan signal line, transmitting a data voltage signal at the data voltage signal line, by the initialization unit, to the gate electrode of the driving transistor, thereby turning on the driving transistor, and transmitting a reference voltage inputted from the reference voltage terminal, by the initialization unit, to the anode of the light-emitting element and the source electrode of the driving transistor. The driving method also comprises: during a threshold detecting period, providing the first level signal to the first scan signal line and the first light-emitting control signal line, providing the second level signal to the second scan signal line and the second light-emitting control signal line, by the initialization unit, transmitting the data voltage signal to the gate electrode of the driving transistor and transmitting the reference voltage to the anode of the light emitting element, and stopping transmitting the reference voltage to the source electrode of the driving transistor, increasing a source voltage of the driving transistor, when the difference between the source voltage and a gate voltage of the driving transistor is equal to a threshold voltage of the driving transistor, turning off driving transistor, and by the threshold detecting unit, detecting the threshold voltage of the driving transistor and holding the source voltage and the gate voltage of the driving transistor. The driving method also comprises: during an electric potential coupling period, providing the first level signal to the second scan signal line, providing the second level signal to the first scan signal line, the first light-emitting control signal line and the second light-emitting control signal line, thereby turning off the driving transistor, and by the compensating unit, transmitting the first power supply voltage signal to the gate electrode of the driving transistor, causing the source voltage of the driving transistor to change, and compensating the threshold voltage of the driving transistor. The driving method also comprises: during a light-emitting period, providing the first level signal to the first light-emitting control signal line and the second light-emitting control signal line, providing a second level signal to the first scan signal line and the second scan signal line, thereby turning on the driving transistor, the light-emitting current flowing through the light-emitting element, and by the light-emitting element, emitting light.

Another aspect of the present disclosure provides an organic light-emitting display panel. The organic light-emitting display panel comprises a plurality of rows of pixel units, wherein a row of pixel units include a plurality of organic light-emitting pixel driving circuits, and an organic light-emitting pixel driving circuit comprises: a driving transistor, a light-emitting element having a cathode connected to a second power supply voltage terminal; an initialization unit connected to a data line and a reference voltage terminal, and under a control of a signal at a first scan signal line, configured to transmit a data voltage signal on the data line to a gate electrode of the driving transistor, and transmit a reference voltage signal from the reference voltage terminal to a source electrode of the driving transistor and an anode of the light-emitting element; a threshold detecting unit connected to the driving transistor and configured to detect a threshold voltage of the driving transistor and hold at least one voltage signal inputted to the driving transistor; a compensating unit connected to the driving transistor, under a control of a signal at a second scan signal line, configured to transmit a first power supply voltage signal outputted from a first power supply voltage terminal to the gate electrode of the driving transistor, a first light-emitting control unit connected to a first light-emitting control signal line; and a second light-emitting control unit connected to a second light-emitting control signal line.

Other aspects of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Reference will now be made in detail to exemplary embodiments of the invention, which are illustrated in the accompanying drawings. Hereinafter, embodiments consistent with the disclosure will be described with reference to drawings. Wherever possible, the same reference numbers will be used throughout the drawings to refer to the same or like parts. It is apparent that the described embodiments are some but not all of the embodiments of the present invention. Based on the disclosed embodiments, persons of ordinary skill in the art may derive other embodiments consistent with the present disclosure, all of which are within the scope of the present invention. Further, in the present disclosure, the disclosed embodiments and the features of the disclosed embodiments may be combined under conditions without conflicts.

In the disclosed embodiments of the present disclosure, the transistors may be thin film transistors or field effect transistors or other devices of the same characteristics. In addition, the transistor in the disclosed embodiments may be an N-type transistor or a P-type transistor. Although certain subsequent description may be made based on N-type transistors, the present disclosure is not limited to N-type transistors. It should be noted that, based on the present disclosure, those skilled in the art can readily implement the disclosed embodiments using P-type transistors without making creative work, all of which are within the scope of the present disclosure.

Figure 1:
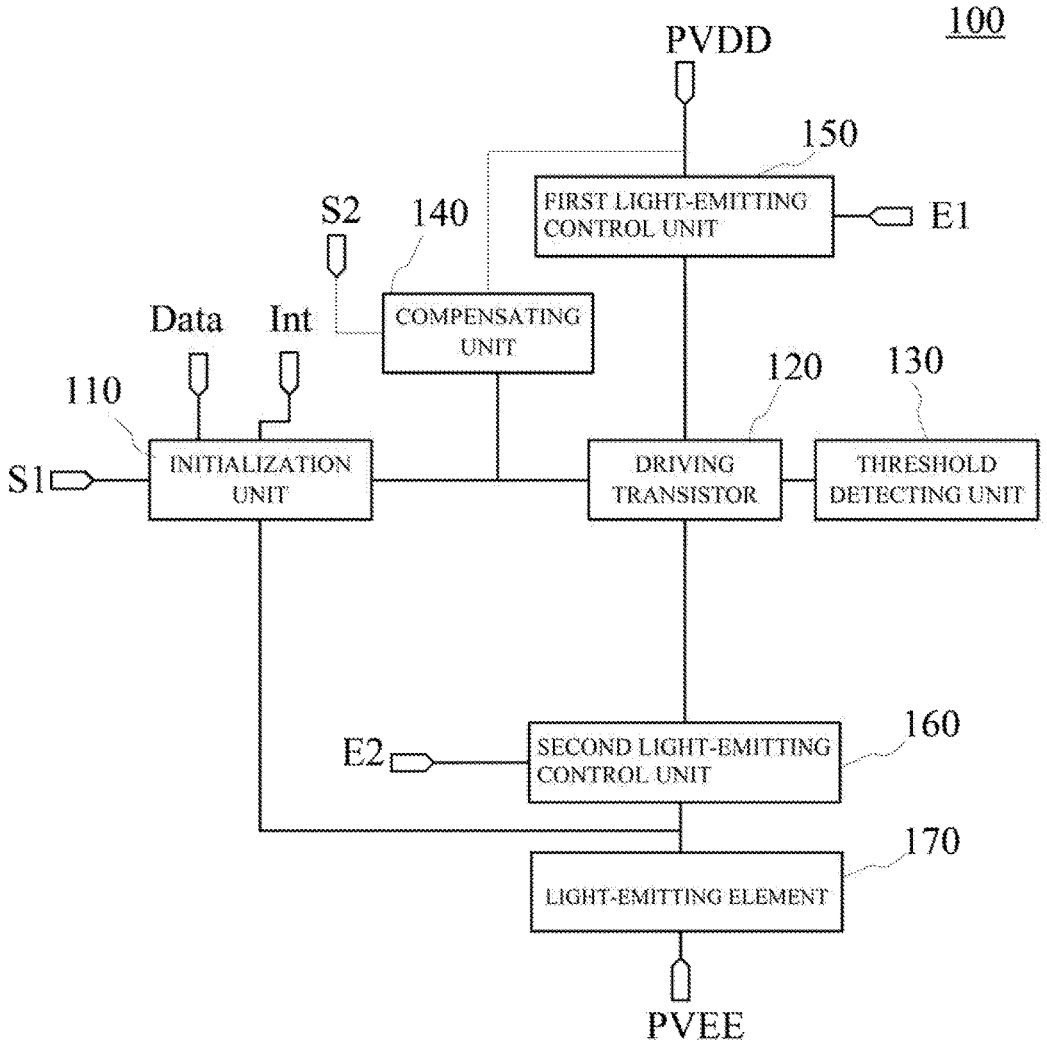
FIG. 1 illustrates a schematic view of an exemplary organic light-emitting pixel driving circuit consistent with disclosed embodiments.

FIG. 1 illustrates a schematic view of an exemplary organic light-emitting pixel driving circuit consistent with disclosed embodiments.

As shown in FIG. 1, the organic light-emitting pixel driving circuit 100 may include an initialization unit 110, a driving transistor 120, a threshold detecting unit 130, a compensating unit 140, a first light-emitting control unit 150, a second light-emitting control unit 160, a light-emitting element 170, a first scan signal line S1, a second scan signal line S2, a first light-emitting control signal line E1, a second light-emitting control signal line E2, a data line Data, a reference voltage terminal Int, a first power supply voltage terminal PVDD, and a second power supply voltage terminal PVEE.

The initialization unit 110 may be connected to the data line Data, the reference voltage terminal Int, and the first scan signal line S1. The initialization unit 110 may transmit a data voltage signal from the data line Data to the gate electrode of the driving transistor 120, under the control of the signal transmitted on the first scan signal line S1. Further, the initialization unit 110 may transmit a reference voltage signal outputted from the reference voltage terminal Int to the source electrode of the driving transistor 120 and the anode of the light-emitting element 170, under the control of the signal transmitted on the first scan signal line S1.

The threshold detecting unit 130 may be connected to the driving transistor 120. The threshold detecting unit 130 may be configured to detect, for example, the threshold voltage of the driving transistor 120. The threshold detecting unit 130 may also be configured to hold the voltage signal inputted to the drive transistor 120 in advance, without the input of an external voltage signal. For example, when no external signal is inputted, the threshold detecting unit 130 may hold the voltage signal inputted to the gate electrode of the driving transistor 120 in advance.

The compensating unit 140 may be connected to the driving transistor 120 and the second scan signal line S2. The compensating unit 140 may transmit a first power supply voltage signal outputted from the first power supply voltage terminal PVDD to the gate electrode of the driving transistor 120, under the control of the signal transmitted on the second scan signal line S2. The first power supply voltage signal transmitted to the gate electrode of the driving transistor 120 may compensate the threshold voltage of the driving transistor 120, such that the light-emitting current generated by the driving transistor 120 may be independent of the threshold voltage of the driving transistor 120.

In one embodiment, the light-emitting current generated by the driving transistor 120 may be related to, for example, the difference between the first power supply voltage signal and the data voltage signal. When the light-emitting current flows through the light-emitting element, the light-emitting current flowing through the light-emitting element may not change due to the change in the threshold voltage of the driving transistor.

Further, the first light-emitting control unit 150 may be connected to the first light-emitting control signal line E1, and the second light-emitting control unit 160 may be connected to the second light-emitting control signal line E2. The first light-emitting control unit 150 and the second light-emitting control unit 160 may be configured to control the light-emitting element 170, such that the light-emitting element 170 may emit light. That is, the first light-emitting control unit 150 and the second light-emitting control unit 160 may simultaneously control whether or not the light emitting element 170 emits light.

The light-emitting element 170 may be any appropriate the light-emitting elements. In one embodiment, the light-emitting element 170 may be, for example, an organic light-emitting diode (OLED). The cathode of the light-emitting element 170 may be connected to the second power supply voltage terminal PVEE. The reference voltage outputted from the reference voltage output terminal Int may be configured to be smaller than the second power supply voltage outputted from the second power supply voltage terminal PVEE, to ensure that no current may flow through the light-emitting element when the reference voltage is provided to the anode of the light-emitting element. Thus, the light-emitting element may be reset.

In certain embodiments, the first light-emitting control signal line E1 and the second scan signal line S2 may be connected via a one-level inverter. Accordingly, the first light-emitting control signal may be generated by the second scan signal generating unit connected to the one-level inverter, such that the generating circuit of the first light-emitting control signal may be simplified and, accordingly, the area occupied by the organic light-emitting pixel driving circuit may be reduced.

In the disclosed embodiments, the initialization unit 110 in the organic light-emitting pixel driving circuit may transmit the data voltage signal to the gate electrode of the driving transistor. The threshold detecting unit 130 may detect the threshold voltage of the driving transistor and may hold the voltages at the gate electrode and at the source electrode. The compensating unit 140 may transmit the first power supply signal to the gate electrode of the driving transistor for compensating the threshold voltage of the driving transistor, such that the light-emitting current generated by the driving transistor for turning on the light-emitting element may be independent of the threshold voltage of the driving transistor. Thus, when an organic light-emitting display panel implemented with the disclosed organic light-emitting pixel driving circuits is displaying an image, the non-uniform brightness caused by different light-emitting currents flowing through the respective light-emitting elements may be suppressed, and the display performance may be enhanced.

Figure 2:
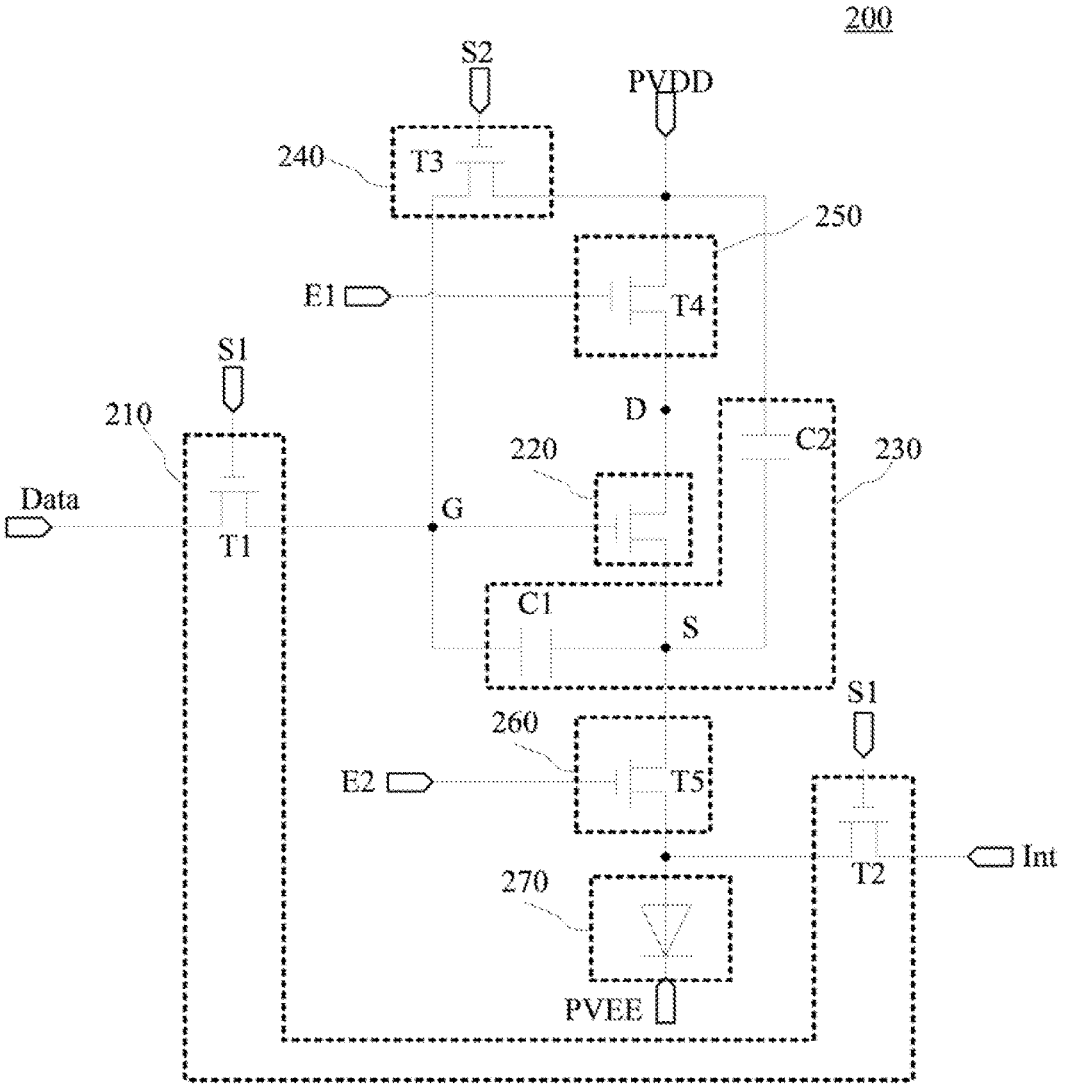
FIG. 2 illustrates a schematic view of another exemplary organic light-emitting pixel driving circuit consistent with disclosed embodiments.

FIG. 2 illustrates a schematic view of another exemplary organic light-emitting pixel driving circuit consistent with disclosed embodiments. The similarities between FIG. 2 and FIG. 1 may not be repeated here, while certain differences may be explained.

Similar to the organic light-emitting pixel driving circuit shown in FIG. 1, the organic light-emitting pixel driving circuit 200 in FIG. 2 may also include an initialization unit 210, a driving transistor 220, a threshold detecting unit 230, a compensating unit 240, a first light-emitting control unit 250, a second light-emitting control unit 260, a light-emitting element 270, a first scan signal line S1, a second scan signal line S2, as well as a first light-emitting control signal line E1, a second light-emitting control signal line E2, a data line Data, a reference voltage terminal Int, a first power supply voltage terminal PVDD, and a second power supply voltage terminal PVEE.

In addition, the initialization unit 210 may be connected to the data line Data, the reference voltage terminal Int, and the first scan signal line S1. The initialization unit 210 may transmit a data voltage signal (data voltage signal, for example, may be expressed as Vdata) from the data line Data to the gate electrode G of the driving transistor 220, under the control of the signal transmitted on the first scan signal line S1. The initialization unit 210 may transmit a reference voltage signal (reference voltage signal, for example, may be expressed as Vint) outputted from the reference voltage terminal Int to the source electrode S of the driving transistor 220 and the anode of the light-emitting element 270, under the control of the signal transmitted on the first scan signal line S1.

The threshold detecting unit 230 may be connected to the driving transistor 220. The threshold detecting unit 230 may detect the threshold voltage of the driving transistor 220. The threshold detecting unit 230 may also be configured to hold the voltage signal inputted to the drive transistor 220 in advance, without any external voltage signal inputted.

The compensating unit 240 may be connected to the driving transistor 220 and the second scan signal line S2. The compensating unit 240 may transmit the first power supply voltage signal (the first power supply voltage signal, for example, may be expressed as VDD) from the first power supply voltage terminal PVDD to the gate electrode G of the drive transistor 220, under the control of the signal transmitted on the second scan signal line S2. And the threshold voltage of the driving transistor 120 may be compensated by the first power supply voltage signal VDD transmitted to the gate electrode G of the driving transistor 120.

The first light-emitting control unit 250 may be connected to the first light-emitting control signal line E1, and the second light-emitting control unit 260 may be connected to the second light-emitting control signal line E2. The first light-emitting control unit 250 and the second light-emitting control unit 260 may be configured to control the light-emitting element 270, such that the light-emitting element 270 may emit light. That is, the first light-emitting control unit 250 and the second light-emitting control unit 260 may simultaneously control whether or not the light emitting element 270 emits light.

The cathode of the light-emitting element 270 may be connected to the second power supply voltage terminal PVEE.

Compared to the organic light-emitting pixel driving circuit in FIG. 1, exemplary circuit diagram of the initialization unit 210, the threshold detecting unit 230, the initialization unit 240, the first light-emitting control unit 250, and the second light-emitting control unit 260 are further illustrated in FIG. 2.

For example, as shown in FIG. 2, the threshold value detecting unit 230 may include a first capacitor C1 and second capacitor C2. The first electrode or the first terminal of the first capacitor C1 is connected to the gate electrode G of the drive transistor 220. The second electrode or the second terminal of the first capacitor C1 is connected to the source electrode S of the drive transistor 220. The first electrode or the first terminal of the second capacitance C2 is connected to the second electrode of the first capacitor C1, and the second electrode or the second terminal of the second capacitor C2 is connected to the first power supply voltage terminal PVDD.

The initialization unit 210 may include a first transistor T1 and a second transistor T2. The gate electrode of the first transistor T1 may be connected to the first scan signal line S1. The first electrode of the first transistor T1 may be connected to the data voltage signal line Data. The second electrode of the first transistor T1 may be connected to the gate electrode G of the driving transistor 220. The gate electrode of the second transistor T2 may be connected to the first scan signal line S1. The first electrode of the second transistor T2 may be connected to the reference voltage terminal Int, and the second electrode of the second transistor T2 may be connected to the anode of the light-emitting element 270.

Thus, when the first transistor T1 is turned on, the data voltage signal Vdata from the data voltage signal line Data may be transmitted to the gate electrode G of the driving transistor 220 and the first electrode of the first capacitor C1, through the turned-on first transistor T1. When the second transistor T2 is turned on, the reference voltage signal Vint from the reference voltage terminal Int may be transmitted to the anode of the light-emitting element 270 through the turned-on second transistor T2, such that the light-emitting element 270 may be reset.

The compensating unit 240 may include a third transistor T3. The gate electrode of the third transistor T3 may be connected to the second scan signal line S2. The first electrode of the third transistor T3 may be connected to the first power supply voltage terminal PVDD. The second electrode of the third transistor T3 may be connected to the gate electrode of the driving transistor 220. When the third transistor T3 is turned on, the first power supply voltage signal VDD from the first power supply voltage terminal PVDD may be transmitted to the gate electrode of the driving transistor 220 through the turned-on third transistor 13.

The first light-emitting control unit 250 may include a fourth transistor T4. The gate electrode of the fourth transistor T4 may be connected to the first light-emitting control signal line E1, the first electrode of the fourth transistor T4 may be connected to the first power supply voltage terminal PVDD, the second electrode of the fourth transistor T4 may be connected to the drain electrode D of the driving transistor 220. Accordingly, when the fourth transistor T4 is turned on under the control of the signal on the first light-emitting control signal line E1, the turned-on fourth transistor T1 may transmit the first power supply voltage signal from the first power supply voltage terminal PVDD to the drain electrode D of the driving transistor 220.

The second light-emitting control unit 260 may include a fifth transistor T5. The gate electrode of the fifth transistor 15 may be connected to the second light-emitting control signal line E2. The first electrode of the fifth transistor T5 may be connected to the source electrode S of the driving transistor 220. The second electrode of the fifth transistor T5 may be connected to the anode of and the light-emitting element 270.

In certain embodiments, the light-emitting element 270 may be an OLED. The cathode of the OLED may be connected to the second power supply voltage terminal PVEE.

Figure 3:
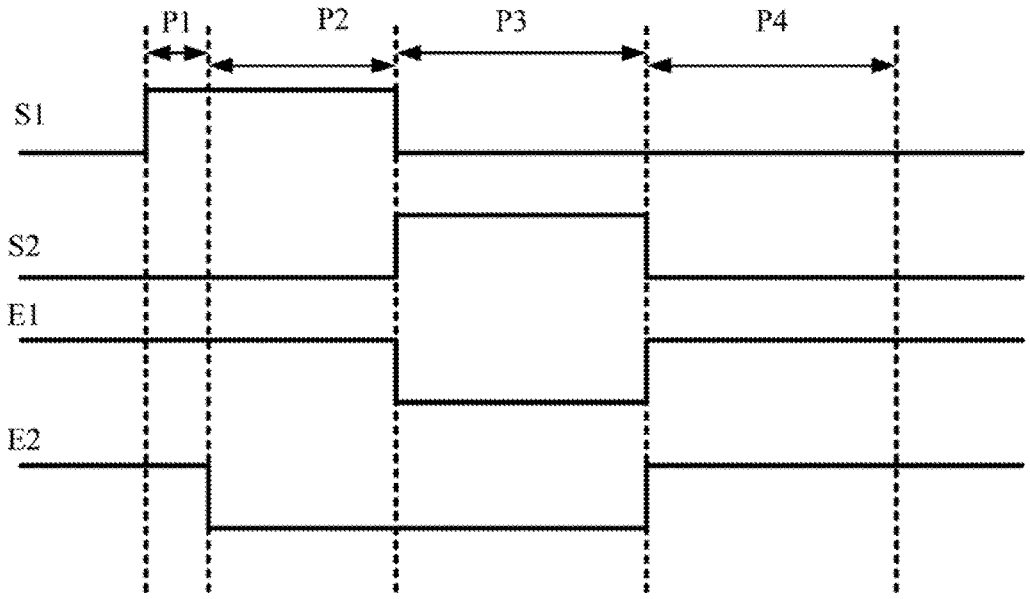
FIG. 3 illustrates an exemplary driving scheme of an exemplary organic light-emitting pixel driving circuit in FIG. 2 consistent with disclosed embodiments.

FIG. 3 illustrates an exemplary driving scheme of an exemplary organic light-emitting pixel driving circuit in FIG. 2 consistent with disclosed embodiments. The operating principles of the organic light-emitting pixel driving circuit shown in FIG. 2, will now be described in conjunction with the driving scheme shown in FIG. 3.

In a first stage P1, a high level signal may be applied to the first scan line S1, the first light-emitting control signal line E1, and the second light-emitting control signal line E2. A low level signal may be applied to the second scan signal line S2. Accordingly, the first transistor T1, the second transistor 12, and the fourth transistor T4, the fifth transistor T5, and the driving transistor 220 may be turned on; and the third transistor T3 may be turned off.

Then, the turned-on first transistor T1 may transmit the data voltage signal Vdata on the data voltage signal line Data to the gate electrode of the driving transistor 220 and the first electrode of the first capacitor C1. The electric potential inputted to the gate electrode G of the driving transistor 220 may be held due to the energy storage effect of the first capacitor C1. The electric potential $V_{G1}$ of the gate electrode G of the driving transistor may be equal to Vdata (i.e. $V_{G1}$=Vdata), where $V_{G1}$ is the gate voltage of the driving transistor 220 in the first stage P1.

The reference voltage signal Vint from the reference voltage terminal Int may be transmitted to the anode of the light-emitting element 270 via the turned-on second transistor T2, and the electric potential of the anode of the light-emitting element 270 may be the reference voltage Vint. When the reference voltage is smaller than the second power supply voltage outputted from the second power supply voltage terminal PVEE, the light emitting element may be reset. On the other hand, the reference voltage signal Vint may be transmitted to the source electrode S of the driving transistor 220 via the path formed by the turned-on second transistor T2 and the turned-on fifth transistor T5.

That is, the voltage $V_{S1}$ of the source electrode S1 of the driving transistor 220 may be $V_{S1}$=Vint, where $V_{S1}$ is the source voltage of the driving transistor 220 in the first stage. Because the second electrode of the first capacitor C1 and the first electrode of the second capacitor C2 are connected to the source electrode S of the driving transistor, the voltage of the second electrode of the first capacitor C1 and the voltage of the first electrode of the second capacitor C2 may be equal to the reference voltage Vint.

In a second stage P2, a high level signal may be applied to the first scan signal line S1 and the first light-emitting control signal line E1. Meanwhile, a low level signal may be applied to the second light-emitting control signal line E2 and the second scan signal line S2. Accordingly, the first transistor T1, the second transistor T2, the fourth transistor T4, and the driving transistor 220 may be turned on, and the third transistor T3 and the fifth transistor T5 may be turned off.

Then, the data voltage signal Vdata on the data line Data may be still transmitted via the turned-on first transistor T1 to the gate electrode G of the driving transistor 220 and the first electrode of the first capacitor C1. That is, $V_{G2}$=Vdata, where $V_{G2}$ is the gate potential of the driving transistor 220 in the second stage P2. The reference voltage signal Vint from the reference voltage terminal Int may be still transmitted via the turned-on second transistor T2 to the anode of the light-emitting element 270, and the light emitting element 270 may be still at the reset state.

On the other hand, because the fifth transistor T5 is turned off, the reference voltage signal Vint may not be transmitted to the source electrode S of the driving transistor 220. Then, the first power supply voltage signal VDD from the first power supply voltage terminal PVDD may charge the second electrode of the first capacitor C1 and the first electrode of the second capacitor C2, via the path formed by the turned-on fourth transistor T4 and the turned-on driving transistor 220.

Thus, the voltage of the source electrode S of the driving transistor 220 may be increased, until the voltage difference between the source electrode S of the driving transistor 220 and the gate electrode G of the driving transistor 220 is equal to the threshold voltage of the driving transistor 220. When the voltage difference between the source electrode S of the driving transistor 220 and the gate electrode G of the driving transistor 220 is equal to the threshold voltage of the driving transistor, the driving transistor 220 may be turned off and the source voltage of the driving transistor 220 may not be increased further.

The electric potential of the source electrode of the driving transistor 220 may be held by the second electrode of the first capacitor and the first electrode of the second capacitor. Accordingly, $V_{S2}$=Vdata−|Vth|, where $V_{S2}$ is the source voltage of the driving transistor 220 in the second stage P2 and Vth is the threshold voltage of the driving transistor 220. Thus, the threshold voltage of the driving transistor 220 may be detected, and the voltages of the gate electrode G and the source electrode S of the driving transistor 220 may be held in the second stage P2.

In a third stage P3, a high level signal may be applied to the second scan signal line S2, and a low level signal may be applied to the first scan signal line S1, the first light-emitting control signal line E1, and the second light-emitting control signal line E2. Accordingly, the third transistor T3 may be turned on, and the first transistor T1, the second transistor T2, the fourth transistor T4, the fifth transistor T5, and the driving transistor 220 may be turned off.

Then, the first power supply voltage signal VDD from the first power supply voltage terminal PVDD may be transmitted via the turned-on third transistor T3 to the gate electrode G of the driving transistor 220, i.e. $V_{G3}$=VDD, where $V_{G3}$ is the voltage of the gate electrode G of the driving transistor 220 in the third stage P3. That is, the first electrode of the first capacitor C1 may be connected to the first power supply voltage terminal PVDD via the turned-on third transistor T3. The second electrode of the second capacitor C2 may be connected to the first power supply voltage terminal PVDD.

Meanwhile, the second electrode of the first capacitor C1 and the first electrode of the second capacitor C2 may be floating. From the second stage P2 to the third stage P3, the voltage at the first electrode C1 of the first capacitor C1 may change from the data voltage signal Vdata to the first power supply voltage signal VDD. The first capacitor C1 may have coupling effect with the second capacitor C2, such that the source potential $V_{S3}$ of the driving transistor 220 may change, where $V_{S3}$ is the source voltage of the driving transistor 220 in the third stage P3.

Further, because the electric potential of the first electrode of the first capacitor C1 changes from the data voltage signal Vdata to the first power supply voltage signal VDD, the amount of stored charge on the first electrode of the first capacitor C1 may be changed. Meanwhile, the second electrode of the second capacitor C2 may be connected to the first power supply voltage terminal PVDD and the amount of charge stored on the second electrode of the second capacitor C2 may not change. Thus, the sum of the charge change amount ΔQ12 on the second electrode of the first capacitor C1 and the charge change amount ΔQ21 on the first electrode of the second capacitor C2 may be equal to the charge change amount ΔQ11 on the first electrode of the first capacitor C1. That is;

$$\Delta Q12+\Delta Q21=\Delta Q11 \quad (1), \text{ where:}$$

$$\Delta Q11=c1\times(VDD-V\text{data}) \quad (2),$$

$$\Delta Q12=(V_{S3}-V_{S2})\times c1 \quad (3), \text{ and}$$

$$\Delta Q21=(V_{S3}-V_{S2})\times c2 \quad (4).$$

Plugging $V_{S2}$=Vdata−|Vth| and Equations (2), (3) and (4) into Equation (1), may yield:

$$V_{S3}=\frac{c1}{c1+c2}(VDD-Vdata)+Vdata-|Vth|, \quad (5)$$

where c1 is the capacitance of the first capacitor C1, and c2 is the capacitance of the second capacitor C2.

In a fourth stage P4, a high level signal may be applied to the first light-emitting control signal line E1 and the second light-emitting control signal line E2, and a low level signal may be applied to the first scan signal line S and the second scan signal line S2. Accordingly, the fourth transistor T4, the fifth transistor T5, and the driving transistor 220 may be turned on; the first transistor T1, the second transistor T2, and the third transistor T3 may be turned off; and the light-emitting element may emit light.

When the light-emitting element 270 emits light, the voltage drop across the light-emitting element 270 may be expressed as Voled. Then, the source potential of the driving transistor may be $V_{S4}$=VEE+Voled.

Then, the first electrode of the first capacitor C1 may be floating. Since the voltage at the second electrode of the first capacitor C1 changes during the transition from the third stage to the fourth stage, the source voltage of the driving transistor may change. That is:

$$V_{S4}-V_{S3}=VEE+Voled-\left(\frac{c1}{c1+c2}(VDD-Vdata)+Vdata-|Vth|\right) \quad (6)$$

Due to the voltage change at the second electrode of the first capacitor C1, the amount of charge on the second electrode of the first capacitor C1 may change. In the first capacitor C1, the first electrode may have the same amount of charge change as the second electrode. That is, in the first capacitor C1, the first electrode may have the same amount of voltage change as the second electrode. Accordingly, the gate electrode G of the driving transistor may have the same amount of voltage change as the source electrode S of the driving transistor, i.e.

$$V_{G4}-V_{G3}=V_{S4}-V_{S3} \quad (7).$$

Plugging $V_{G3}$=VDD and Equation (6) into Equation (7) may yield $$V_{G4}=VEE+Voled-\left(\frac{c1}{c1+c2}(VDD-Vdata)+Vdata-|Vth|\right)+VDD,$$

which may be simplified into:

$$V_{G4}=VEE+Voled+\frac{c2}{c1+c2}(VDD-Vdata)+|Vth|. \quad (8)$$

According to the formula for the light-emitting current, in the fourth stage P4, the light-emitting current flowing through the light emitting element may be:

$$I=k(V_{GS}-|Vth|)^2=k(V_{G4}-V_{S4}-|Vth|)^2 \quad (9).$$

Plugging $V_{S4}$=VEE+Voled and Equation (8) into Equation (9) may yield:

$$I=k\left(\frac{c2}{c1+c2}(VDD-Vdata)\right)^2, \quad (10)$$

where k is a parameter relating to the aspect ratio of the driving transistor.

As Equation (10) shows, the light-emitting current I may be independent of the threshold voltage Vth of the driving transistor 220. Thus, when the ratio of the capacitance c1 of the first capacitor C1 to the capacitance c2 of the second capacitor C2 is a constant, and when a same data voltage signal Vdata and a same first power supply voltage signal VDD are applied to the organic light-emitting pixel driving circuit, a same light-emitting current I may be generated, thereby preventing the threshold voltage of the driving transistor 220 from influencing the light-emitting current I. Further, when the disclosed organic light-emitting pixel driving circuit is applied to the organic light-emitting display panel, because the light-emitting current is independent of the threshold voltage of the driving transistor, non-uniform brightness due to different threshold voltages of the driving transistors may be suppressed.

On the other hand, the magnitude of the light-emitting current may be adjusted by adjusting the ratio of the capacitance c1 of the first capacitor C1 to the capacitance c2 of the second capacitor C2, such that the luminance of the organic light-emitting may be adjusted.

The capacitance c2 of the second capacitor C2 may be greater than the capacitance c1 of the first capacitor C1, such that a substantially large light-emitting current may be generated. For example, the capacitance of the second capacitor C2 may be configured as $90\times10^{-15}$ F to $100\times10^{-15}$ F, and the capacitance of the first capacitor C1 may be configured as $10\times10^{-15}$ F to $30\times10^{-15}$ F. Thus, the generated light-emitting current I by the driving transistor 220 may be substantially large. The range may be $$k\left(\frac{3}{4}(VDD-Vdata)\right)^2 \sim k\left(\frac{10}{11}(VDD-Vdata)\right)^2.$$

Because the second capacitor C2 is configured to have a larger capacitance than the first capacitor C1, a substantially large light-emitting current may be generated, and the organic light-emitting pixel driving circuit may have a substantially strong driving capability. Accordingly, a higher luminance may be generated given the same first power supply voltage signal and the data voltage signal, and the power consumption of the organic light-emitting pixel driving circuit may be reduced.

In addition, as the driving scheme shown in FIG. 3 shows, the signal transmitted on the first light-emitting control signal line may be inverted with respect to the signal transmitted on the second scan signal line. Thus, the second scan signal line may be connected to the first light-emitting control signal line via a one-level inverter. For example, the second scan signal line may be indirectly connected to the first light-emitting control signal line via the one-level inverter. That is, the circuit generating the signal transmitted on the second scan signal line may be connected to the one-level inverter to generate the signal transmitted on the first light-emitting control signal line, thereby reducing the area occupied by the organic light-emitting pixel driving circuit.

Figure 4:
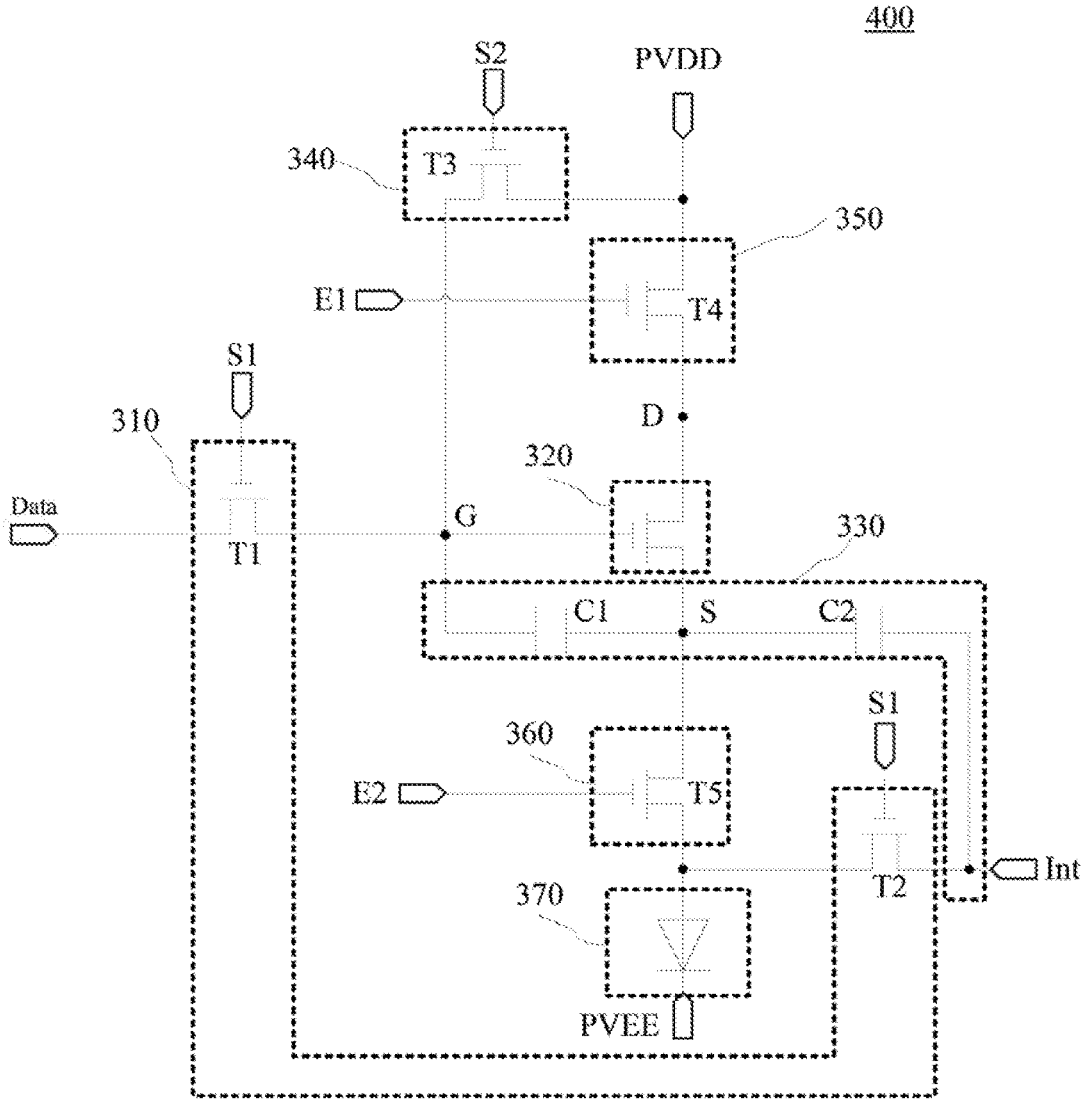
FIG. 4 illustrates a schematic view of another exemplary organic light-emitting pixel driving circuit consistent with disclosed embodiments.

FIG. 4 illustrates a schematic view of another exemplary organic light-emitting pixel driving circuit consistent with disclosed embodiments. The similarities between FIG. 4 and FIG. 2 may not be repeated here, while certain differences may be explained.

Similar to the organic light-emitting pixel driving circuit 200 shown in FIG. 2, as shown in FIG. 4, the organic light-emitting pixel driving circuit 400 in FIG. 4 may include an initialization unit 310, a driving transistor 320, a threshold detecting unit 330, a compensating unit 340, a first light-emitting control unit 350, a second light-emitting control unit 360, a light-emitting element 370, a first scan signal line S1, a second scan signal line S2, a first light-emitting control signal line E1, a second light-emitting control signal line E2, a data line Data, a reference voltage terminal Int, a first power supply voltage terminal PVDD, and a second power supply voltage terminal PVEE.

The initialization unit 310 may include a first transistor T and a second transistor T2. The initialization unit 310 may be connected to the data line Data and the reference voltage terminal Int, as well as the first scan signal line S1. The initialization unit 310 may transmit the data voltage signal Vdata on the data line Data to the gate electrode of the driving transistor 320 under the control of the signal on the first scan signal line S1. Further, the initialization unit 310 may transmit the reference voltage signal Vint from the reference voltage terminal Int to the source electrode of the driving transistor 320 and the anode of the light-emitting element 370, under the control of the signal on the first scan signal line S1.

The threshold detecting unit 330 may include a first capacitor C1 and a second capacitor C2. The threshold detecting unit 330 may be connected to the driving transistor 320. The threshold detecting unit 330 may detect the threshold voltage of the driving transistor 320 and may hold the voltage signals inputted to the gate electrode and the source electrode of the driving transistor 320.

The compensating unit 340 may include a third transistor T3. The compensating unit 340 may be connected to the driving transistor 320 and the second scan signal line S2. The compensating unit 340 may transmit the first power supply voltage signal from the first power supply voltage terminal PVDD to the gate electrode G of the driving transistor 320 under the control of the signal on the second scan signal line S2. And the threshold voltage of the driving transistor 320 may be compensated by the first power supply voltage signal transmitted to the gate electrode of the driving transistor 320.

The first light-emitting control unit 350 may include a fourth transistor T4. The first light-emitting control unit 350 may be connected to the first light-emitting control signal line E1. The second light-emitting control unit 360 may include a fifth transistor T5. The second light-emitting control unit 360 may be connected to the second light-emitting control signal line E2. The first light-emitting control unit 350 and the second light-emitting control unit 360 may be configured to control whether or not the light-emitting element 370 emits light, such that the light-emitting element 370 may emit light.

The cathode of the light-emitting element 370 may be connected to the second power supply voltage terminal PVEE.

Different from the organic light-emitting pixel driving circuit 200 in FIG. 2, in the organic light-emitting pixel 400 shown FIG. 4, in the two capacitors C1 and C2 of the threshold detecting unit 330, the first electrode of the second capacitor C2 may be connected to the second electrode of the first capacitor C1, and the second electrode of the second capacitor C2 may be connected to the reference voltage terminal Int.

The operating principles of the organic light-emitting pixel driving circuit 400 shown in FIG. 4 will be described with reference to the driving scheme shown in FIG. 3.

From the first stage P1 to the fourth stage P4, the second electrode of the second capacitor C2 may be connected to the reference voltage terminal Int. That is, in the disclosed embodiments, as shown in FIG. 4, the second electrode of the second capacitor C2 may be connected to a fixed electric potential Vint. The amount of charge stored on the second electrode of the second capacitor C2 may not vary with the change in the amount of charge stored on the first electrode of the second capacitor C2.

In the first stage P1, the second stage P2, the third stage P3, and the fourth stage P4, the voltage change of the source electrode S, the drain electrode D, and the gate electrode G of the driving transistor 320 in FIG. 4 may be same as in FIG. 2. Further, in the fourth stage P4, the light-emitting current I flowing through the light-emitting element 370 in FIG. 4 may be same as the light-emitting current I flowing through the light-emitting element 270 in FIG. 2. And the light-emitting current of the light-emitting element 370 may be acquired as shown in the Equation (10), which will not be further described here.

Thus, the light-emitting current I may be independent of the threshold voltage Vth of the driving transistor 320. Given a constant proportional relationship between the capacitance c1 of the first capacitor C1 and the capacitance c2 of the second capacitor C2, when the same data voltage signal and the same first power supply voltage signal are applied to the disclosed organic light-emitting pixel driving circuit, same light-emitting current I may be generated.

In addition, the light-emitting current I flowing through the light-emitting element may be adjusted by adjusting the proportional relationship between the capacitance c1 of the first capacitor C1 and the capacitance c2 of the second capacitor C2, such that the luminance of the light-emitting element may be adjusted. For example, when the first capacitor C1 and the second capacitor C2 is being fabricated, the desired capacitance c1 of the first capacitor C1 may be $10\times10^{-15}$ F and the desired capacitance c2 of the second capacitor C2 may be $100\times10^{-15}$ F. Due to process deviation, the capacitance of each first capacitor may be difficult to be maintained at $10\times10^{-15}$ F and the capacitance of each second capacitor may be difficult to be maintained at $100\times10^{-15}$ F.

Accordingly, the desired light-emitting current may be generated by ensuring that the ratio of the capacitance of the first capacitor C1 to the capacitance of C2 is 1:10. Because the uniform luminance of the light-emitting elements may be generated by controlling the proportional relationship between the capacitance c1 of the first capacitance C1 and the capacitance c2 of the second capacitor C2 in the organic light-emitting pixel driving circuit, process requirements for manufacturing the organic light-emitting pixel driving circuits may be reduced. That is, the manufacturing the organic light-emitting pixel driving circuits may be simplified, and the corresponding cost may be reduced.

In the organic light-emitting pixel driving circuit 400 in FIG. 4, the second electrode of the second capacitor C2 may be connected to the reference voltage terminal Int, and the light-emitting element may have a same light-emitting current as the light-emitting element shown in FIG. 2. Accordingly, the connection position of the second capacitor may be adjusted according to the circuit diagram in the organic light-emitting display panel, such that the area occupied by the organic light-emitting pixel driving circuit may be reduced.

Figure 5:
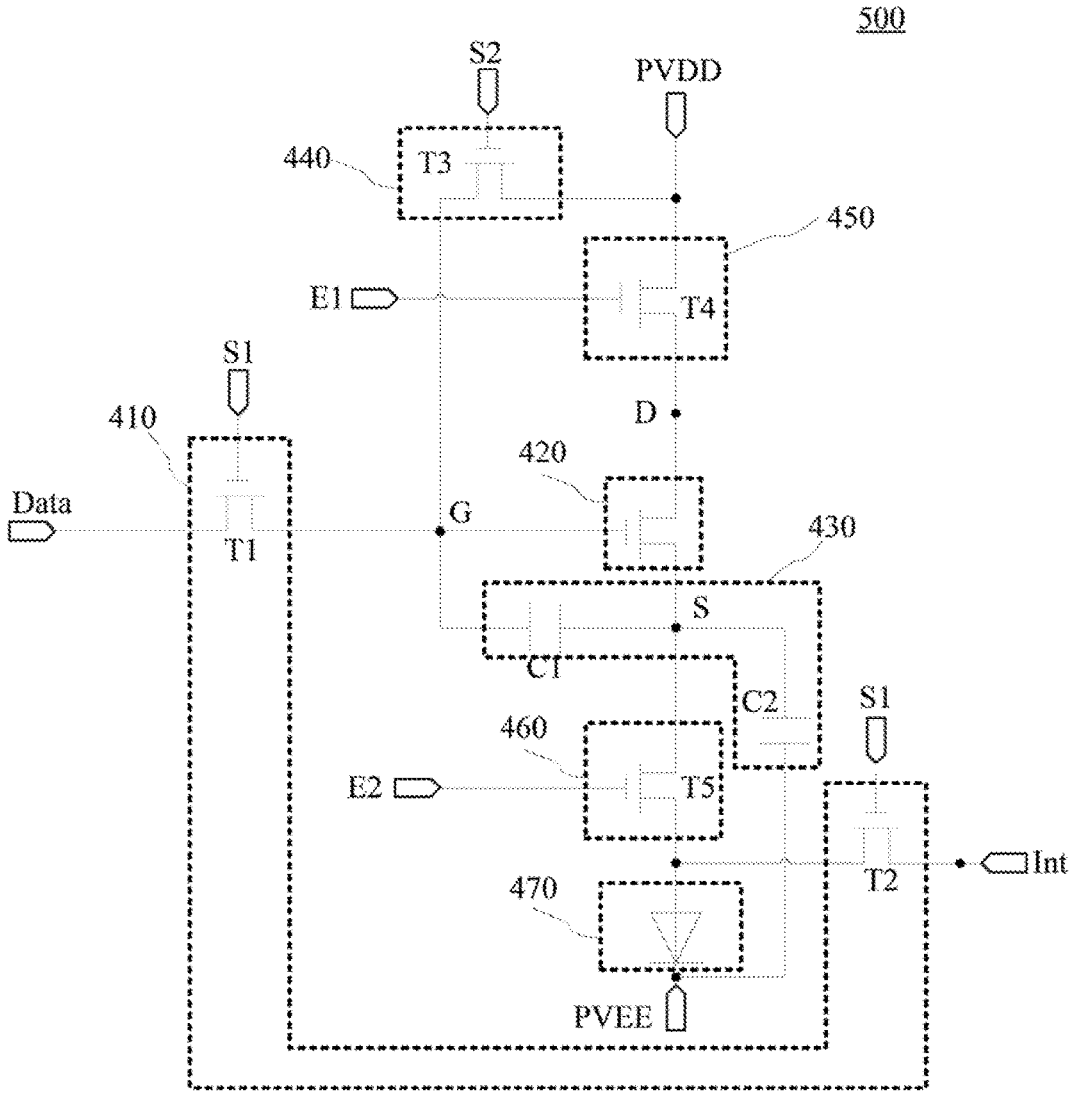
FIG. 5 illustrates a schematic view of another exemplary organic light-emitting pixel driving circuit consistent with disclosed embodiments.

FIG. 5 illustrates a schematic view of another exemplary organic light-emitting pixel driving circuit consistent with disclosed embodiments. The similarities between FIG. 5 and FIG. 2 as well as FIG. 4 may not be repeated here, while certain differences may be explained.

Similar to the organic light-emitting pixel driving circuits shown in FIG. 2 and FIG. 4, in FIG. 5, the organic light-emitting pixel driving circuit 500 in FIG. 5 may include an initialization unit 410, a driving transistor 420, a threshold detecting unit 430, a compensating unit 440, a first light-emitting control unit 450, a second light-emitting control unit 460, a light-emitting element 470, a first scan signal line S1, a second scan signal line S2, a first light-emitting control signal line E1, a second light-emitting control signal line E2, a data line Data, a reference voltage terminal Int, a first power supply voltage terminal PVDD, and a second power supply voltage terminal PVEE.

The initialization unit 410 may include a first transistor T1 and a second transistor T2. The initialization unit 410 may be connected to the data line Data and the reference voltage terminal Int, as well as the first scan signal line S1. The initialization unit 410 may transmit the data voltage signal on the data line Data to the gate electrode G of the driving transistor 320 under the control of the signal on the first scan signal line S1, and may transmit the reference voltage signal from the reference voltage terminal Int to the source electrode S of the driving transistor 420 and the anode of the light-emitting element 470 under the control of the signal on the first scan signal line S1.

The threshold detecting unit 430 may include a first capacitor C1 and a second capacitor C2. The threshold detecting unit 430 may be connected to the driving transistor 420. The threshold detecting unit 430 may detect the threshold voltage of the driving transistor 420 and hold the voltage signal inputted to the gate electrode and the source electrode of the driving transistor 420.

The compensating unit 440 may include a third transistor T3. The compensating unit 440 may be connected to the driving transistor 420 and the second scan signal line S2. The compensating unit 440 may transmit the first power supply voltage signal VDD from the first power supply voltage terminal PVDD to the gate electrode G of the driving transistor 420 under the control of the signal on the second scan signal line S2. And the threshold voltage of the driving transistor 420 may be compensated by the first power supply voltage signal VDD transmitted to the gate electrode G of the driving transistor 420.

The first light-emitting control unit 450 may include a fourth transistor T4. The first light-emitting control unit 450 may be connected to the first light-emitting control signal line E1. The second light-emitting control unit 460 may include a fifth transistor T5. The second light-emitting control unit 460 may be connected to the second light-emitting control signal line E2. The first light-emitting control unit 450 and the second light-emitting control unit 460 may be configured to control the light-emitting element 470, such that the light-emitting element 470 may emit light. That is, the first light-emitting control unit 450 and the second light-emitting control unit 460 may simultaneously control whether or not the light-emitting element 470 emits light.

The cathode of the light-emitting element 470 may be connected the second power supply voltage terminal PVEE.

Different from the disclosed organic light-emitting pixel driving circuits shown in FIG. 2 and FIG. 4, in organic light-emitting pixel driving circuit 500 shown in FIG. 5, in the two electrodes C1 and C2 included in the threshold detecting unit 440, the first electrode of the second capacitor C2 may be connected to the second electrode of the first capacitor C1, and the second electrode of the second capacitor C2 may be connected to the second power supply voltage terminal PVEE.

The operating principles of the disclosed organic light-emitting pixel driving circuit shown in FIG. 5 will be now described with reference to the driving scheme shown in FIG. 3.

From the first stage P1 to the fourth stage P4, the second electrode of the second capacitor C2 may be connected to the second voltage terminal PVEE. That is, in the disclosed embodiments, as shown in FIG. 5, the second electrode of the second capacitor C2 may be connected to a fixed electric potential VEE, and the amount of charge stored on the second electrode of the second capacitor C2 may not vary with the change in the amount of charge stored on the first electrode of the second capacitor C2.

For the first stage P1, the second stage P2, the third stage P3, and the fourth stage P4, the voltage change of the source electrode, the drain electrode, and the gate electrode of the driving transistor in FIG. 5 may be same as in FIG. 2 and FIG. 4. Further, in the fourth stage P4, the light-emitting current flowing through the light emitting element in FIG. 5 may be same as the light-emitting current flowing through the light-emitting elements in FIG. 2 and FIG. 4. The light-emitting current of the light-emitting element in FIG. 5 may be acquired as shown in Equation (10), which will not be further described here.

Thus, in the organic light-emitting pixel driving circuit 500, the light-emitting current I may be independent of the threshold voltage Vth of the driving transistor 420. Given that a proportional relationship between the capacitance of the first capacitor C1 and the capacitance of the second capacitor C2 is a constant, when a same data voltage signal and a same first power supply voltage signal are applied to the disclosed organic light-emitting pixel driving circuit, a same light-emitting current I may be generated.

In addition, the light-emitting current flowing through the light-emitting element may be adjusted by adjusting the proportional relationship between the capacitance of the first capacitor C1 and the capacitance of the second capacitor C2, such that the luminance of the light-emitting element may be adjusted. Further, in the organic light-emitting pixel display panel, because the uniform luminance of the light-emitting elements may be generated by controlling the ratio of the capacitance of the first capacitor C1 to the capacitance of the second capacitor C2 in the organic light-emitting pixel driving circuits, process requirements for manufacturing the organic light-emitting pixel driving circuits may be reduced.

Further, the second capacitor may be connected to the second power supply voltage terminal and, meanwhile, the second power supply voltage terminal may be connected to the cathode of the organic light-emitting element. The second power supply voltage terminal may be connected to the cathode layer of the organic light-emitting pixel display panel. Accordingly, the connection line between the second capacitor and the second power supply voltage terminal may be configured at a layer different from the first power supply voltage terminal, the reference voltage terminal, the first scan signal line S1, the second scan signal line S2, the first light-emitting control signal line E1, and the second light-emitting control signal line E2.

Thus, the second capacitor may be connected to the second power supply voltage terminal according to the circuit diagram of the organic light-emitting pixel driving circuit, thereby reducing the area occupied by the organic light-emitting pixel driving circuit. In addition, the second power supply voltage signal line (the signal line for the second power supply voltage signal terminal) may provide the second power supply voltage signal to the second capacitor, and the interference between the second power supply voltage signal line providing the voltage signal to the second capacitor and the signals transmitted on other signal lines may be suppressed.

The present disclosure also provides a driving method of the organic light-emitting pixel driving circuits, which may be adopted to drive any of the disclosed organic light-emitting pixel driving circuits.

Figure 6:
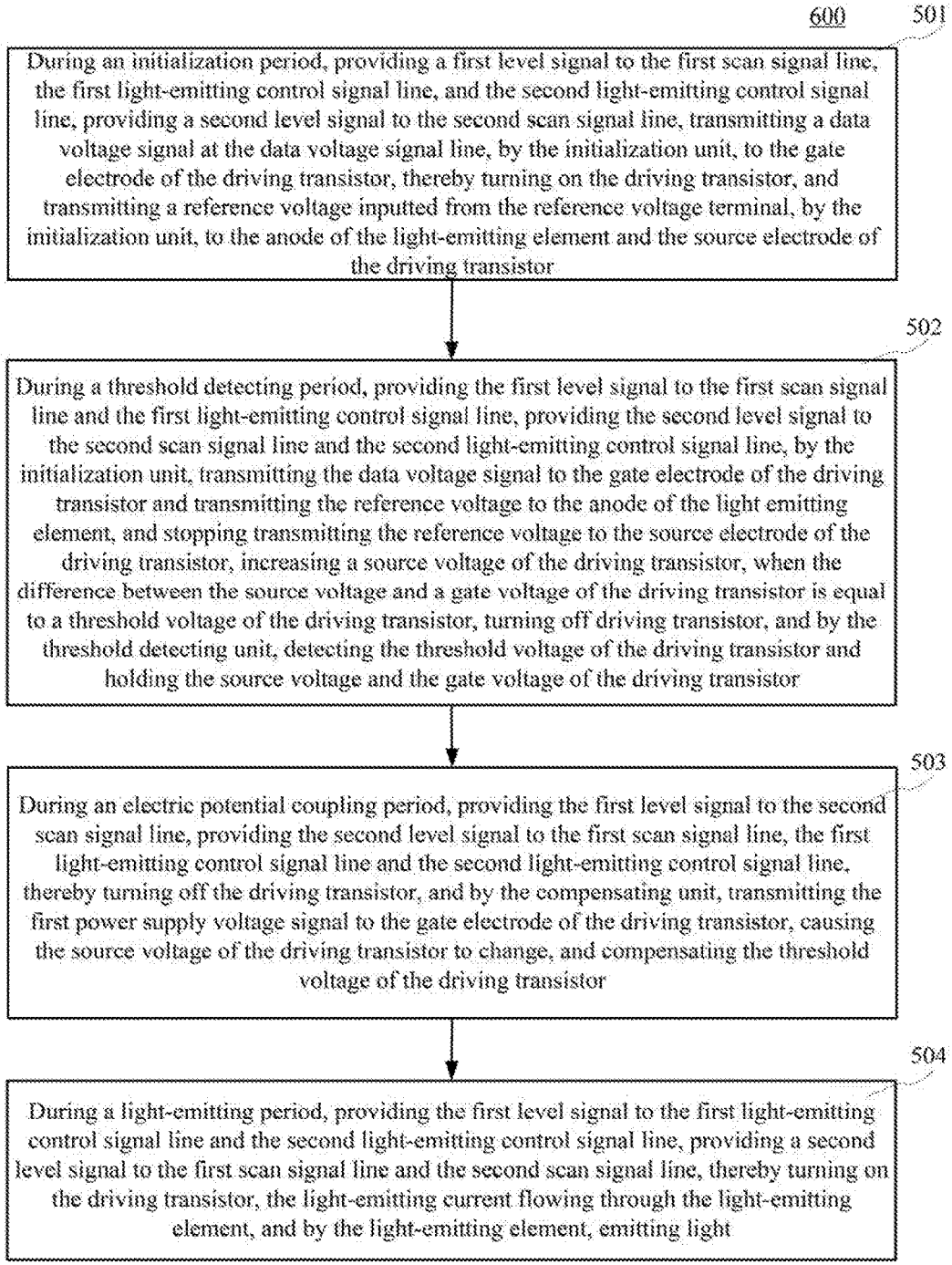
FIG. 6 illustrates a flow chart of an exemplary driving method for an exemplary organic light-emitting pixel driving circuit consistent with disclosed embodiments.

FIG. 6 illustrates a flow chart 600 of an exemplary driving method of an exemplary organic light-emitting pixel driving circuit consistent with disclosed embodiments.

In step 501, during the initialization period, a first level signal may be provided to the first scan signal line, the first light-emitting control signal line, and the second light-emitting control signal line. Meanwhile, a second level signal may be provided to the second scan signal line.

Then, the initialization unit may transmit the data voltage signal on the data voltage signal line to the gate electrode of the driving transistor to turn on the driving transistor, and may transmit the reference voltage from the reference voltage terminal to the anode of the light-emitting element and the source electrode of the driving transistor.

In step 502, during the threshold detecting period, a first level signal may be provided to the first scan signal line and the first light-emitting control signal line. Meanwhile a second level signal may be provided to the second scan signal line and the second light-emitting control signal line.

Then, the initialization unit may continue transmitting the data voltage signal to the gate electrode of the driving transistor, and transmitting the reference voltage to the anode of the light-emitting element, and may stop transmitting the reference voltage to the source electrode of the driving transistor. Accordingly, the source voltage of the driving transistor may be increased. When the difference between the source voltage and the gate voltage of the driving transistor is equal to the threshold voltage of the driving transistor, the driving transistor may be turned off. Thus, the threshold detecting unit may detect the threshold voltage of the driving transistor and hold the source voltage and the gate voltage of the driving transistor.

In step 503, during the electric potential coupling period, a first level signal may be provided to the second scan signal line. Meanwhile, a second level signal may be provided to the first scan signal line, the first light-emitting control signal line and the second light-emitting control signal line.

Then, the compensating unit may transmit the first power supply voltage signal from the first power supply voltage terminal to the gate electrode of the driving transistor, such that the source voltage may change with the change of the gate electric potential to compensate the threshold voltage of the driving transistor, and the driving transistor may be turned off. The compensating unit may transmit the first power supply voltage signal to the gate electrode of the driving transistor, causing the source voltage of the driving transistor to change, and compensating the threshold voltage of the driving transistor.

In step 504, during the light-emitting period, a first level signal may be provided to the first light-emitting control signal line and the second light-emitting control signal line. Meanwhile, a second level signal may be provided to the first scan signal line and the second scan signal line.

Then, the driving transistor may be turned on, the light-emitting current may flow through the light-emitting element under the control of the first light-emitting control unit and the second light-emitting control unit, and the light-emitting element may emit light. The light-emitting current flowing through the light-emitting element may be independent of the threshold voltage of the driving transistor.

Here, when the driving method of the organic light-emitting pixel driving circuit is applied to the organic light-emitting pixel driving circuits shown in FIG. 2, FIG. 4 or FIG. 5, the driving scheme of the signals in the steps 501-504 may be referred to FIG. 3.

In certain embodiment, the reference voltage outputted from the reference voltage terminal may be smaller than the voltage from the second power supply voltage terminal. Thus, in the threshold detecting period (e.g., P2 period in FIG. 3), the voltage applied to the anode of the light-emitting element may be smaller than or equal to the voltage applied to the cathode of the light-emitting element, thereby suppressing the leak current generated when the voltage applied to the anode of the light-emitting element is greater than the voltage applied to the cathode of the light-emitting element. Thus, in the threshold detecting period (e.g., P2 period in FIG. 3), the light-emitting element may not emit light. That is, the dark-state display performance of disclosed organic light-emitting display panel implemented with the disclosed organic light-emitting pixel driving circuits may be improved. Accordingly, the contrast ratio of the organic light-emitting display panel may be improved.

Figure 7:
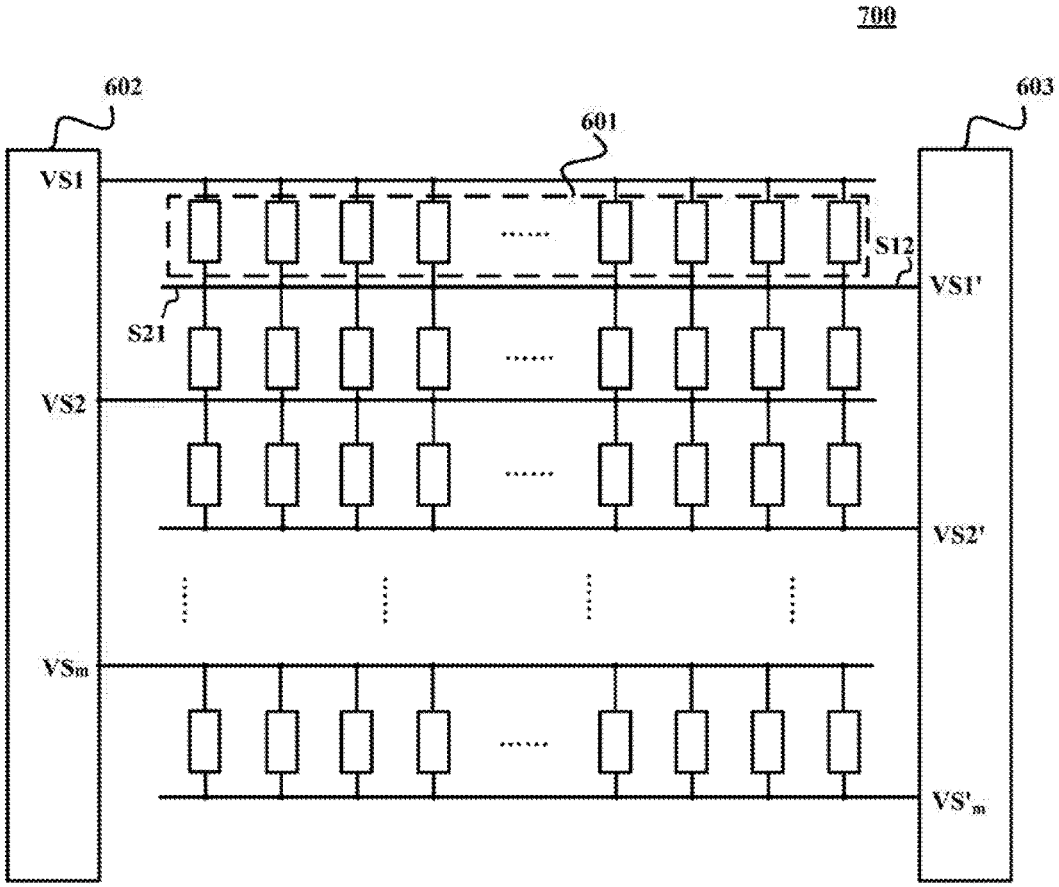
FIG. 7 illustrates a schematic view of an exemplary organic light-emitting display panel consistent with disclosed embodiments.

FIG. 7 illustrates a schematic view of an exemplary organic light-emitting display panel consistent with disclosed embodiments.

As shown in FIG. 7, the organic light-emitting display panel 700 may include a plurality of rows of pixel units 601, a first shift register 602 and a second shift register 603. A row of pixel units 601 (i.e., a pixel unit row) may include a plurality of pixel units. A pixel unit may include an organic light-emitting pixel driving circuit, which may be any one of the disclosed organic light-emitting pixel driving circuits. Each pixel unit 601 row may be connected to a first scan signal line and a second scan signal line.

Further, the first shift register 602 may include a plurality of shift register units VS1, VS2 to VSm, each of which may provide a scan signal to the first scan signal line of the pixel units in an odd-numbered pixel unit row. The second shift register 603 may include a plurality of shift register units VS1', VS2' to VSm'. Except the last shift register unit VSm', the shift register units VS1', VS2' to VS (m−1)' each may provide a scan signal to the first scan signal line of the pixel units in an even-numbered pixel unit row.

The first scan signal line of the pixel units in an even-numbered pixel unit row may be shared as or multiplexed as the second scan signal line of the pixel units in the preceding pixel unit row. Meanwhile, except the first pixel unit row, the first scan signal line of the pixel units in an odd-numbered pixel unit row may be shared as or multiplexed as the second scan signal line of the pixel units in the preceding pixel unit row.

That is, the second scan signal line in the i-th pixel unit row may be shared as the first scan signal line of the i+1-th pixel unit row, where i is a positive integer greater than or equal to 1, and i is smaller than the total row number of the pixel units of the organic light-emitting display panel. For example, as shown in FIG. 7, the second scan signal line S12 of the first row of pixel units may be shared as the first scan signal line S21 of the second pixel unit row.

Thus, the configuration for the first scan signal line and the second scan signal line in each row may reduce the area occupied by the pixel driving circuits in the display panel, facilitating the implementation of the disclosed pixel driving circuits into display panels with high PPI (Pixels Per Inch).

Further, because the disclosed organic light-emitting pixel driving circuit may compensate the threshold voltage of the driving transistor, brightness uniformity of the disclosed organic light-emitting display panel may be improved.

Figure 8:
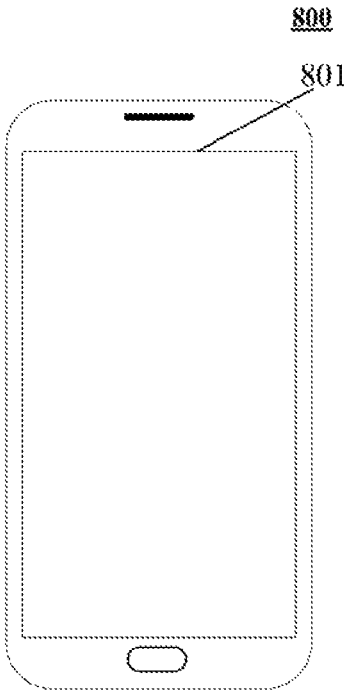
FIG. 8 illustrates a schematic view of an exemplary organic light-emitting display device consistent with disclosed embodiments.

The present disclosure also provides an organic light-emitting display device. FIG. 8 illustrates a schematic view of an exemplary organic light-emitting display device 800 consistent with disclosed embodiments. As shown in FIG. 8, the organic light-emitting display device 800 may include any one of the disclosed organic light-emitting display panels 801. The disclosed organic light-emitting display device 800 may be a cell phone, a tablet, a monitor, and a smart wearable display device, etc. Any organic light-emitting display device comprising any one of the disclosed organic light-emitting display panels will fall within the scope of the present disclosure. Although a smart phone is shown in FIG. 8, the disclosed organic light-emitting display device is not limited to the smart phone.

The present disclosure provides an organic light-emitting pixel driving circuit, a driving method for the organic light-emitting pixel driving circuit, and an organic light-emitting display panel. The disclosed organic light-emitting pixel driving circuit may include an initialization unit, a threshold detecting unit, a compensating unit, a first light-emitting control unit, a second light-emitting control unit, a driving transistor, a light-emitting element, a data line, a first scan signal line, a second scan signal line. The initialization unit may transmit the data voltage signal to the gate electrode of the driving transistor. The threshold detecting unit may detect the threshold voltage of the driving transistor. The compensating unit may transmit the first power supply voltage signal to the gate electrode of the driving transistor to compensate the threshold voltage of the driving transistor. The first light-emitting control unit and the second light-emitting control unit may be configured to control the light-emitting element, such that the light-emitting element may emit light. The cathode of the light-emitting element may be connected to the second power supply voltage terminal.

In the disclosed organic light-emitting pixel driving circuit, the light-emitting current of the light-emitting element may be independent of the threshold voltage of the driving transistor. The brightness uniformity of the disclosed organic light-emitting display panel may be improved. The area occupied by the disclosed organic light-emitting pixel driving circuit may be reduced.

The description of the disclosed embodiments is provided to illustrate the present invention to those skilled in the art. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. An organic light-emitting pixel driving circuit, comprising:

a driving transistor;

a light-emitting element having a cathode connected to a second power supply voltage terminal;

an initialization unit connected to a data line and a reference voltage terminal, and under a control of a signal at a first scan signal line, configured to transmit a data voltage signal on the data line to a gate electrode of the driving transistor, and transmit a reference voltage signal from the reference voltage terminal to a source electrode of the driving transistor and an anode of the light-emitting element;

a threshold detecting unit connected to the driving transistor and configured to detect a threshold voltage of the driving transistor and hold at least on voltage signal inputted to the driving transistor;

a compensating unit connected to the driving transistor, under a control of a signal at a second scan signal line, configured to transmit a first power supply voltage signal outputted from a first power supply voltage terminal to the gate electrode of the driving transistor;

a first light-emitting control unit connected to a first light-emitting control signal line; and a second light-emitting control unit connected to a second light-emitting control signal line.

2. The organic light-emitting pixel driving circuit according to claim 1, wherein:

the compensating unit is configured to compensate the threshold voltage of the driving transistor; and the first light-emitting control unit and the second light-emitting control unit are configured to control whether the light-emitting element emits light.

3. The organic light-emitting pixel driving circuit according to claim 2, wherein:

the initialization unit comprises a first transistor and a second transistor;

the first transistor has a gate electrode connected to the first scan signal line, a first electrode connected to the data voltage signal line, and a second electrode connected to the gate electrode of the driving transistor; and the second transistor has a gate electrode connected to the first scan signal line, a first electrode connected to the reference voltage terminal, and a second electrode connected to the anode of the light-emitting element.

4. The organic light-emitting pixel driving circuit according to claim 3, wherein:

the threshold detecting unit includes a first capacitor and a second capacitor;

the first capacitor has a first electrode connected to the gate electrode of the driving transistor, and a second electrode connected to the source electrode of the driving transistor; and the second capacitor has a first electrode connected to the second electrode of the first capacitor, and a second electrode connected to the first power supply voltage terminal.

5. The organic light-emitting pixel driving circuit according to claim 4, wherein:

the compensating unit includes a third transistor; and the third transistor has a gate electrode connected to the second scan signal line, a first electrode connected to the first power supply voltage terminal, and a second electrode connected to the gate electrode of the driver transistor.

6. The organic light-emitting pixel driving circuit according to claim 5, wherein:

the first light-emitting control unit includes a fourth transistor; and the fourth transistor has a gate electrode connected to the first light-emitting control signal line, a first electrode connected to the first power supply voltage terminal, and a second electrode connected to a drain electrode of the driving transistor.

7. The organic light-emitting pixel driving circuit according to claim 6, wherein:

the second light-emitting control unit includes a fifth transistor; and the fifth transistor has a gate electrode connected to the second light-emitting control signal line, a first electrode connected to the source electrode of the drive transistor, and a second electrode connected to the anode of the light-emitting element.

8. The organic light-emitting pixel driving circuit according to claim 3, wherein:

the threshold detecting unit includes a first capacitor and a second capacitor;

the first capacitor has a first electrode connected to the gate electrode of the driving transistor, and a second electrode connected to the source electrode of the driving transistor; and the second capacitor has a first electrode connected to the second electrode of the first capacitor, and a second electrode connected to the second power supply voltage terminal.

9. The organic light-emitting pixel driving circuit according to claim 3, wherein:

the threshold detecting unit includes a first capacitor and a second capacitor;

the first capacitor has a first electrode connected to the gate electrode of the driving transistor, a second electrode connected to the source electrode of the driving transistor; and the second capacitor has a first electrode connected to the second electrode of the first capacitor, and a second electrode connected to the reference voltage terminal.

10. The organic light-emitting pixel driving circuit according to claim 2, wherein:

the first light-emitting control signal line is connected to the second scan signal line via a one-level inverter.

11. The organic light-emitting pixel driving circuit according to claim 2, wherein:

the light-emitting element is an organic light-emitting diode (OLED).

12. A driving method for driving an organic light-emitting pixel driving circuit comprising a driving transistor; a light-emitting element having a cathode connected to a second power supply voltage terminal; an initialization unit connected to a data line and a reference voltage terminal, and under a control of a signal at a first scan signal line, configured to transmit a data voltage signal on the data line to a gate electrode of the driving transistor, and transmit a reference voltage signal from the reference voltage terminal to a source electrode of the driving transistor and an anode of the light-emitting element; a threshold detecting unit connected to the driving transistor and configured to detect a threshold voltage of the driving transistor and hold at least one voltage signal inputted to the driving transistor; a compensating unit connected to the driving transistor, under a control of a signal at a second scan signal line, configured to transmit a first power supply voltage signal outputted from a first power supply voltage terminal to the gate electrode of the driving transistor; a first light-emitting control unit connected to a first light-emitting control signal line; and a second light-emitting control unit connected to a second light-emitting control signal line, the driving method comprising:

during an initialization period, providing a first level signal to the first scan signal line, the first light-emitting control signal line, and the second light-emitting control signal line, providing a second level signal to the second scan signal line, transmitting a data voltage signal at the data voltage signal line, by the initialization unit, to the gate electrode of the driving transistor, thereby turning on the driving transistor, and transmitting a reference voltage inputted from the reference voltage terminal, by the initialization unit, to the anode of the light-emitting element and the source electrode of the driving transistor; and during a threshold detecting period, providing the first level signal to the first scan signal line and the first light-emitting control signal line, providing the second level signal to the second scan signal line and the second light-emitting control signal line, by the initialization unit, transmitting the data voltage signal to the gate electrode of the driving transistor and transmitting the reference voltage to the anode of the light emitting element, and stop transmitting the reference voltage to the source electrode of the driving transistor, increasing a source voltage of the driving transistor, when the difference between the source voltage and a gate voltage of the driving transistor is equal to a threshold voltage of the driving transistor, turning off driving transistor, and by the threshold detecting unit, detecting the threshold voltage of the driving transistor and holding the source voltage and the gate voltage of the driving transistor; and during an electric potential coupling period, providing the first level signal to the second scan signal line, providing the second level signal to the first scan signal line, the first light-emitting control signal line and the second light-emitting control signal line, thereby turning off the driving transistor, and by the compensating unit, transmitting the first power supply voltage signal to the gate electrode of the driving transistor, causing the source voltage of the driving transistor to change, and compensating the threshold voltage of the driving transistor; and during a light-emitting period, providing the first level signal to the first light-emitting control signal line and the second light-emitting control signal line, providing a second level signal to the first scan signal line and the second scan signal line, thereby turning on the driving transistor, the light-emitting current flowing through the light-emitting element, and by the light-emitting element, emitting light.

13. The driving method according to claim 12, wherein:

the reference voltage is smaller than a voltage outputted from the second power supply terminal.

14. The driving method according to claim 12, further comprising:

during the threshold detecting period, holding the source voltage and the gate voltage of the driving transistor by a first capacitor and a second capacitor included in the threshold detecting unit.

15. The driving method according to claim 12, wherein:

the threshold detecting unit includes a first capacitor and a second capacitor;

the first capacitor has a first electrode connected to the gate electrode of the driving transistor, and a second electrode connected to the source electrode of the driving transistor; and the second capacitor has a first electrode connected to the second electrode of the first capacitor, and a second electrode connected to the first power supply voltage terminal; and from the threshold detecting period to the electric potential coupling period, a sum of a charge change amount at the second electrode of the first capacitor and the charge change amount at the first electrode of the second capacitor is equal to the charge change amount at the first electrode of the first capacitor.

16. An organic light-emitting display panel, comprising a plurality of rows of pixel units, wherein a row of pixel units include a plurality of organic light-emitting pixel driving circuits, and an organic light-emitting pixel driving circuit comprises:

a driving transistor;

a light-emitting element having a cathode connected to a second power supply voltage terminal;

an initialization unit connected to a data line and a reference voltage terminal, and under a control of a signal at a first scan signal line, configured to transmit a data voltage signal on the data line to a gate electrode of the driving transistor, and transmit a reference voltage signal from the reference voltage terminal to a source electrode of the driving transistor and an anode of the light-emitting element;

a threshold detecting unit connected to the driving transistor and configured to detect a threshold voltage of the driving transistor and hold at least one voltage signal inputted to the driving transistor;

a compensating unit connected to the driving transistor, under a control of a signal at a second scan signal line, configured to transmit a first power supply voltage signal outputted from a first power supply voltage terminal to the gate electrode of the driving transistor;

a first light-emitting control unit connected to a first light-emitting control signal line; and a second light-emitting control unit connected to a second light-emitting control signal line.

17. The organic light-emitting display panel according to claim 16, wherein:

the row of pixel units are connected to one first scan signal line and one second scan signal line.

18. The organic light-emitting display panel according to claim 16, wherein:

the second scan signal line of an i-th row of pixel units are shared as the first scan signal line of an (i+1)-th row of pixel units, where i is a positive integer.

19. The organic light-emitting display panel according to claim 16, further comprising:

a first shift register and a second shift register.

20. An organic light-emitting display device, comprising the organic light-emitting display panel according to claim 16.

* * * * *